US009227240B2

(12) United States Patent
MacAdams

(10) Patent No.: US 9,227,240 B2
(45) Date of Patent: Jan. 5, 2016

(54) CRIMPING HEAD FOR IMPACT WRENCH

(71) Applicant: Conbraco Industries, Inc., Matthews, NC (US)

(72) Inventor: Glenn David MacAdams, Pageland, SC (US)

(73) Assignee: CONBRACO INDUSTRIES, INC., Matthews, NC (US)

( * ) Notice: Subject to any disclaimer, the term of this patent is extended or adjusted under 35 U.S.C. 154(b) by 378 days.

(21) Appl. No.: 13/910,713

(22) Filed: Jun. 5, 2013

(65) Prior Publication Data

US 2014/0360243 A1 Dec. 11, 2014

(51) Int. Cl.
*B21D 39/04* (2006.01)
*B25B 27/10* (2006.01)

(52) U.S. Cl.
CPC ..... *B21D 39/046* (2013.01); *B21D 39/048* (2013.01); *B25B 27/10* (2013.01)

(58) Field of Classification Search
CPC ..... B25B 19/00; B25B 27/02; B25B 27/10; B21D 39/046; B21D 39/048; H01R 43/0428
USPC ..... 279/143, 144, 145; 72/416
See application file for complete search history.

(56) References Cited

U.S. PATENT DOCUMENTS

| | | | | |
|---|---|---|---|---|
| 2,714,026 | A * | 7/1955 | Schultz | 403/183 |
| 5,330,206 | A * | 7/1994 | Krumszyn et al. | 279/144 |
| 7,435,924 | B2 * | 10/2008 | Schmitt-Walter et al. | 219/86.33 |
| 7,959,371 | B2 * | 6/2011 | Keightley | 403/348 |
| 8,342,001 | B2 | 1/2013 | Zhang | |
| 8,622,667 | B1 * | 1/2014 | Seay | 408/239 A |
| 2009/0311061 | A1 * | 12/2009 | Santamarina et al. | 408/239 A |
| 2010/0095534 | A1 * | 4/2010 | Saiz | 30/272.1 |
| 2011/0127054 | A1 * | 6/2011 | Chen | 173/114 |
| 2011/0173802 | A1 | 7/2011 | Dierks et al. | |
| 2011/0289998 | A1 | 12/2011 | Zhang | |

OTHER PUBLICATIONS

International Search Report dated Jun. 13, 2014 for International Application No. PCT/US2014/019272.

Langnau; Rigid Shaft Coupling Adapters from Stafford; Design World Articles; Sep. 28, 2011; (May 28, 2014). Retrieved from Internet:<URL: http://www.designworldonline.com/rigid-shaft-coupling-adapters-from-stafford.

* cited by examiner

*Primary Examiner* — Edward Tolan
(74) *Attorney, Agent, or Firm* — Shumaker, Loop & Kendrick, LLP

(57) ABSTRACT

A crimping head for use with an impact wrench to crimp fittings onto a structure carrying the fitting, that includes a universal adaptor having a head, and a socket positioned in the head sized and shaped to receive a standard anvil of an impact wrench without further connection between the impact wrench and the crimping head. A locking assembly is provided for cooperating with the universal adaptor head for locking the anvil into the socket, and a transmission is attached to the universal adaptor for being driven by the universal adaptor and for converting rotational movement of the anvil into selective rearward and forward movement. A jaw assembly is attached to the transmission and adapted to close into a crimping position and open into a release position responsive to the rearward and forward movement of the transmission.

10 Claims, 6 Drawing Sheets

CRIMPING HEAD FOR IMPACT WRENCH

TECHNICAL FIELD AND BACKGROUND OF THE INVENTION

The invention described and claimed in this application relates to a power operated crimping tool adapted to be attached to and driven by an impact wrench, which may be corded, cordless, or pneumatic. The crimping head has particular application in crimping connection fittings onto pipe, conduit, hose, and the like. Presently, there is a wide range of power and manual tools available for this purpose. Devices such as pressing tongs are used primarily for sanitary installations in order to connect two pipes or pipe sections to one another by means of connecting fittings. For this purpose, the connecting members are slipped over the ends of two pipes and are then plastically deformed in order to achieve a fixed connection between the two pipes by means of the fitting. The pressing tongs have two jaws for this purpose with machined system-specific pressing contours, respectively. In order to actuate the pressing jaws and, in particular, to exert the pressing force, the pressing tongs are connected by a connector to a motor-driven actuating device having an axially movable plunger that operates electro-mechanically or electro-hydraulically. The plunger supports pressing rolls by which, upon extension of the plunger, the pressing tongs are closed and the pressing force is exerted.

U.S. Pat. No. 8,342,001 discloses a power operated crimping/cutting tool driven by an impact wrench, with a crimping or cutting working head that includes a transmission unit and a connection. The transmission unit includes a jaw and a transmission. The jaw is detachable, and the connection is mounted by a sleeve onto the impact wrench. However, the design of this unit is such that attachment elements, such as connecting shafts, clamps, plates and bolts are needed for attaching the crimping jaws to the impact wrench, and may vary in size and shape depending on the type and brand of impact wrench being used.

Thus, there is a need for an attachment for use with an impact wrench that is "universal," in that the crimping head can be attached to the driving head of any conventional impact wrench without the need of connecting shafts, clamps, plates and bolts, as with the design disclosed in U.S. Pat. No. 8,342,001. The disclosed crimping jaws are also interchangeable left to right.

SUMMARY OF THE INVENTION

Therefore, it is an object of the present invention to provide a power operated crimping tool driven by an impact wrench.

It is another object of the invention to provide a power operated crimping tool that fits onto any conventional impact wrench without attachment members usable with only certain sized or shaped impact wrenches.

It is another object of the invention to provide a power operated crimping tool that provides a universal fit.

It is another object of the invention to provide a power operated crimping tool that uses Allen screws with a locking feature that prevents the crimping head from vibrating loose from the impact wrench during use.

These and other objects and advantages are achieved by providing a crimping head for use with an impact wrench to crimp fittings onto a structure carrying the fitting, that includes a universal adaptor having a head, and a socket positioned in the head sized and shaped to receive a standard anvil of an impact wrench without further connection between the impact wrench and the crimping head. A locking assembly is provided for cooperating with the universal adaptor head for locking the anvil into the socket, and a transmission is attached to the universal adaptor for being driven by the universal adaptor and for converting rotational movement of the anvil into selective rearward and forward movement. A jaw assembly is attached to the transmission and adapted to close into a crimping position and open into a release position responsive to the rearward and forward movement of the transmission.

According to one embodiment of the invention, the transmission comprises a housing mounted in a stationary position between the universal adaptor and the jaw assembly, and a mounting plate positioned for forward and rearward movement within the housing responsive to rotation of the anvil of the impact wrench. A pair of drive plates are mounted for pivotal movement on the mounting plate responsive to forward and rearward movement within the housing responsive to rotation of the anvil of the impact wrench. The drive plates are mounted on rearward ends of clamping arms carried by the jaw assembly so that the outward movement of forward ends of the drive plates drives rearward ends of the clamping arms outwardly and forward ends of the clamping arms having opposing jaws inwardly into crimping position.

According to another embodiment of the invention, the locking assembly includes a radial split in the adaptor head through the socket and defining a gap, at least one through hole extending through the adaptor head and split, and a screw positioned in the through hole for being tightened to close the gap and lock the anvil in the socket.

According to another embodiment of the invention, a cover is positioned over at least a rearward portion of the transmission.

According to another embodiment of the invention, the universal adaptor head includes a drive screw threaded into a bore formed in the mounting plate for driving the mounting plate forwardly and rearwardly in the transmission housing.

According to another embodiment of the invention, the drive screw includes trapezoidal screw threads.

According to another embodiment of the invention, a transmission cover is positioned over at least a rearward portion of the transmission and a drive screw cover positioned over the drive screw.

According to another embodiment of the invention, the transmission includes an elongate housing mounted in a stationary position between the universal adaptor and the jaw assembly, and having a top and bottom defining a movement path. A mounting plate is positioned for forward and rearward movement within the movement path of the housing responsive to rotation of the anvil of the impact wrench, and a pair of drive plates is mounted for pivotal movement on the mounting plate responsive to forward and rearward movement within the housing responsive to rotation of the anvil of the impact wrench. The drive plates are mounted on rearward ends of clamping arms carried by the jaw assembly, so that outward movement of forward ends of the drive plates drives rearward ends of the clamping arms outwardly and forward ends of the clamping arms having opposing jaws inwardly into crimping position.

According to another embodiment of the invention, a crimping head is provided in combination with an electric impact wrench to crimp fittings onto a structure carrying the fitting, that includes a universal adaptor having a head, and a socket positioned in the head sized and shaped to receive a standard anvil of an impact wrench without further connection between the impact wrench and the crimping head. A locking assembly is provided for cooperating with the universal adaptor head for locking the anvil into the socket, and a transmission is attached to the universal adaptor for being driven by the universal adaptor and for converting rotational movement of the anvil into selective rearward and forward movement. A jaw assembly is attached to the transmission and adapted to close into a crimping position and open into a release position responsive to the rearward and forward movement of the transmission.

According to another embodiment of the invention, a method of crimping a fitting onto a structure carrying the fitting is provided and includes the steps of providing crimping head for use with an impact wrench to crimp fittings onto a structure carrying the fitting, that includes a universal adaptor having a head, and a socket positioned in the head sized and shaped to receive a standard anvil of an impact wrench without further connection between the impact wrench and the crimping head. A locking assembly cooperates with the universal adaptor head for locking the anvil into the socket, and a transmission is attached to the universal adaptor for being driven by the universal adaptor and for converting rotational movement of the anvil into selective rearward and forward movement. A jaw assembly is attached to the transmission and adapted to close into a crimping position and open into a release position responsive to the rearward and forward movement of the transmission. The impact wrench is operated to drive the jaw assembly into a crimping position.

BRIEF DESCRIPTION OF THE DRAWINGS

The present invention is best understood when the following detailed description of the invention is read with reference to the accompanying drawings, in which.

DETAILED DESCRIPTION OF THE PREFERRED EMBODIMENT

Figure 1:
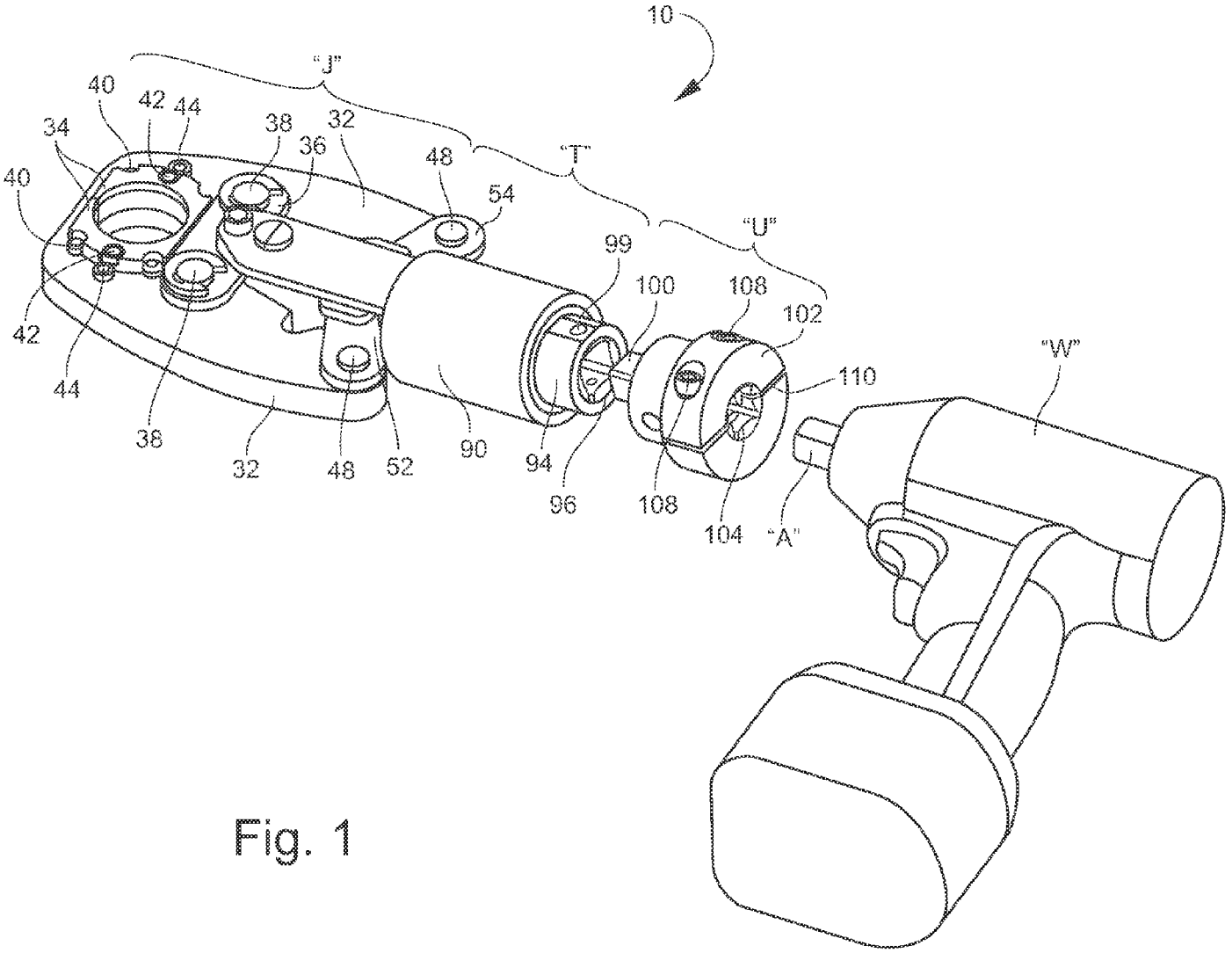
FIG. 1 is a perspective view of a crimping head, with parts removed for clarity, for an impact wrench according to a first preferred embodiment of the present invention.
Figure 2:
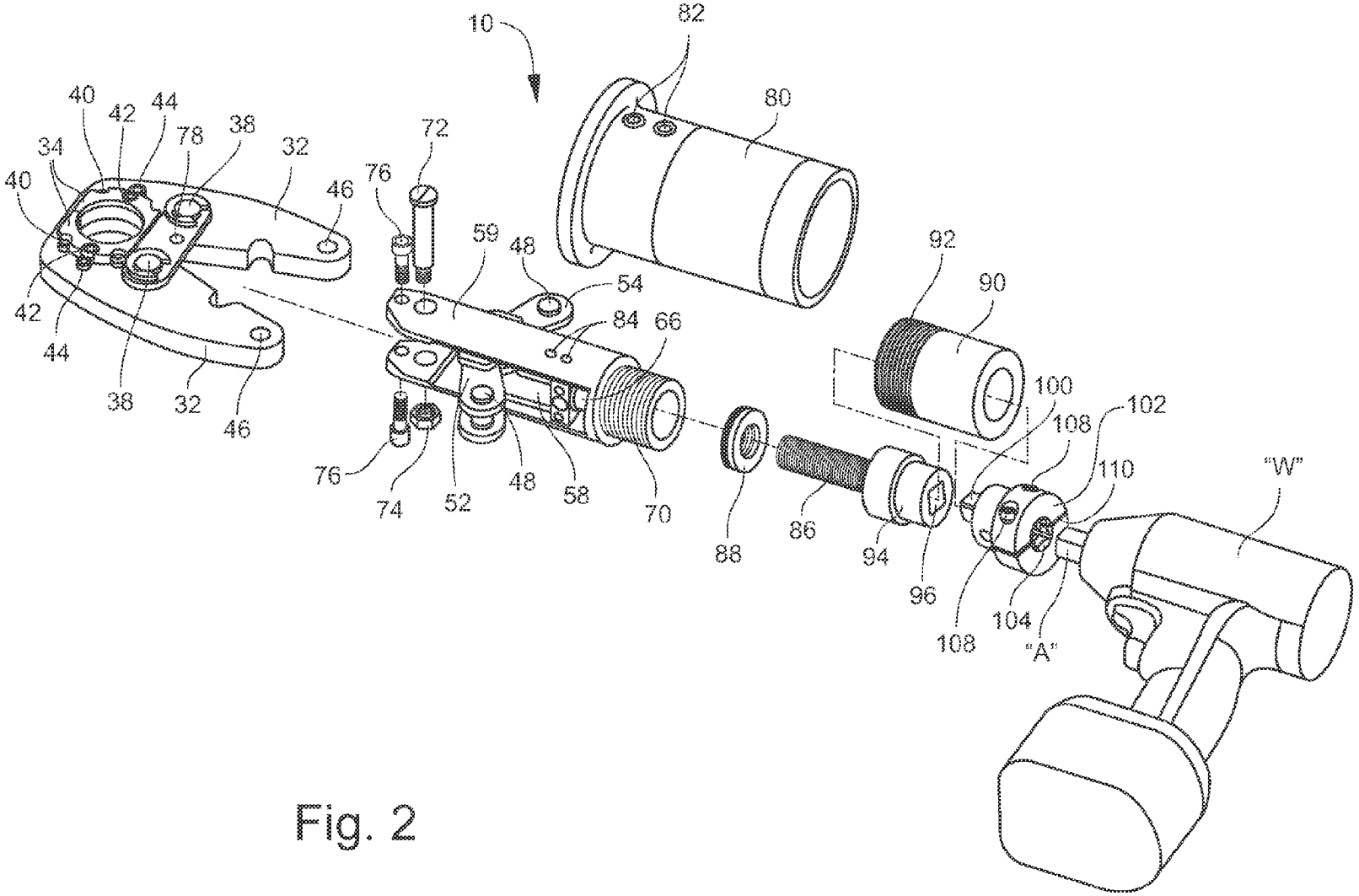
FIG. 2 is an exploded perspective view of the crimping head and impact wrench according to the preferred embodiment of the present invention shown in FIG. 1.
Figure 3:
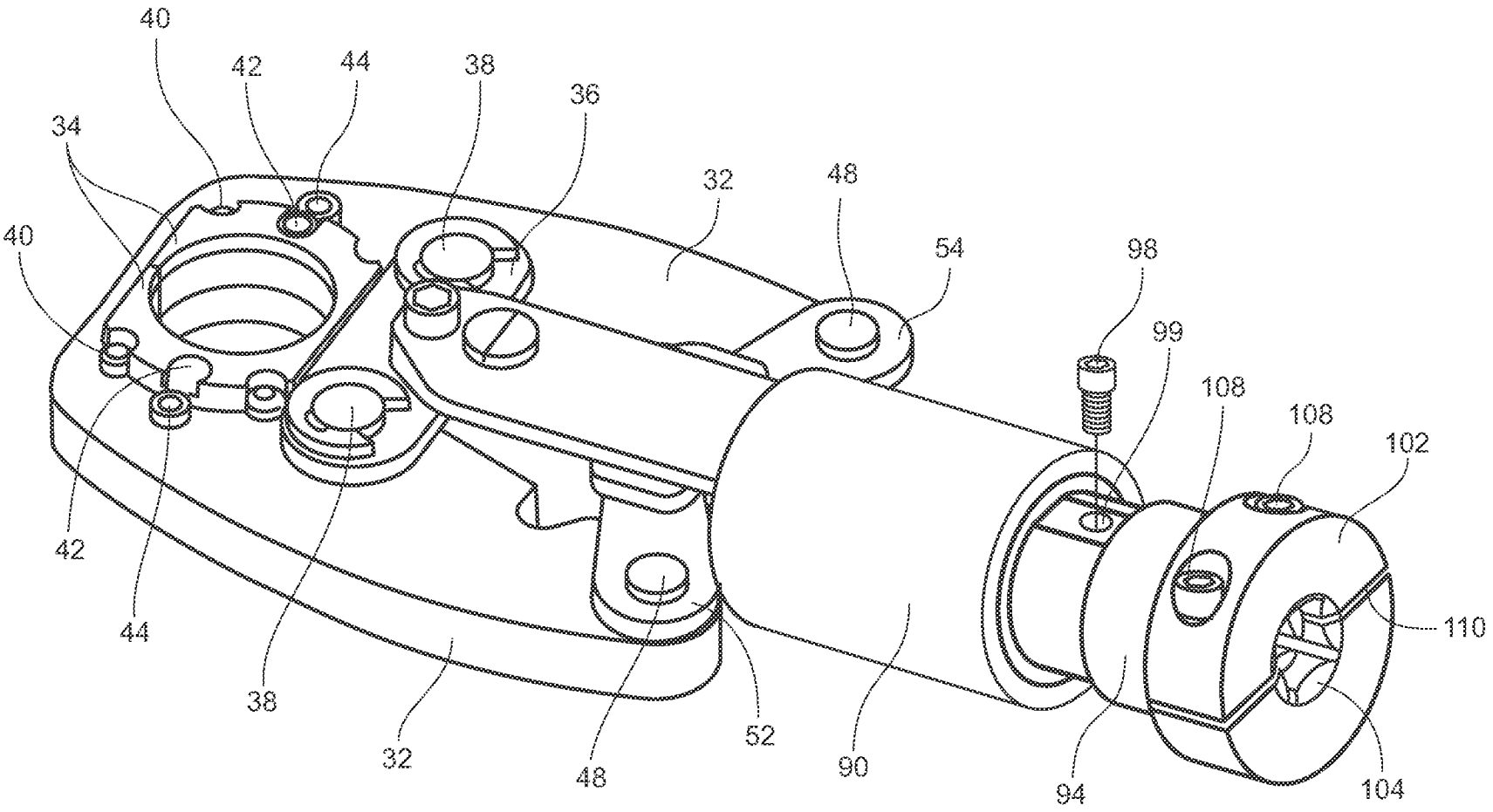
FIG. 3 is an exploded perspective view of the jaws of the preferred embodiment of the present invention.

Referring now specifically to the drawings, a crimping head is shown and generally indicated at reference numeral 10 in FIGS. 1, 2 and 3. The crimping head 10 is adapted to fit universally onto any conventional impact wrench, such as the cordless impact wrench shown at "W." The crimping head 10 is formed of a jaw assembly "J", a transmission assembly "T" and a universal connection assembly "U." These elements are connected together as described and are attached to an anvil of an impact wrench "W." Rotary motion from the impact wrench "W" is passed through the universal connection assembly "U" to the transmission assembly "T", where the rotary motion is translated into straight line motion that pivots a pair of clamping arms 32 which in turn open or close a pair of semi-circular, interchangeable jaws 34 that form part of the jaw assembly "J", and that engage the tubular element to be crimped. The jaws 34 are preferably reversible left to right.

In addition to the pair of clamping arms 32 and the pair of jaws 34, jaw assembly "J" includes top and bottom covers 36 (top shown) that enclose a pair of pivot pins 38 about which the clamping arms 32 pivot. A pair of jaw positioning pins 40 and a pair of jaw locking pins 42 are used to position and lock the jaws 34 in the correct operating position. Spring-loaded release buttons 44 are provided to spring load the jaw locking pins 42. When removal and replacement of the jaws 34 is required, the jaws 34 are removed by pressing down the jaw locking pins 42 against the bias of the spring-loaded release buttons 44. A pair of attachment holes 46 are provided for mounting the clamping arms 32 by bolts to the transmission assembly "T", as described below.

Figure 4:
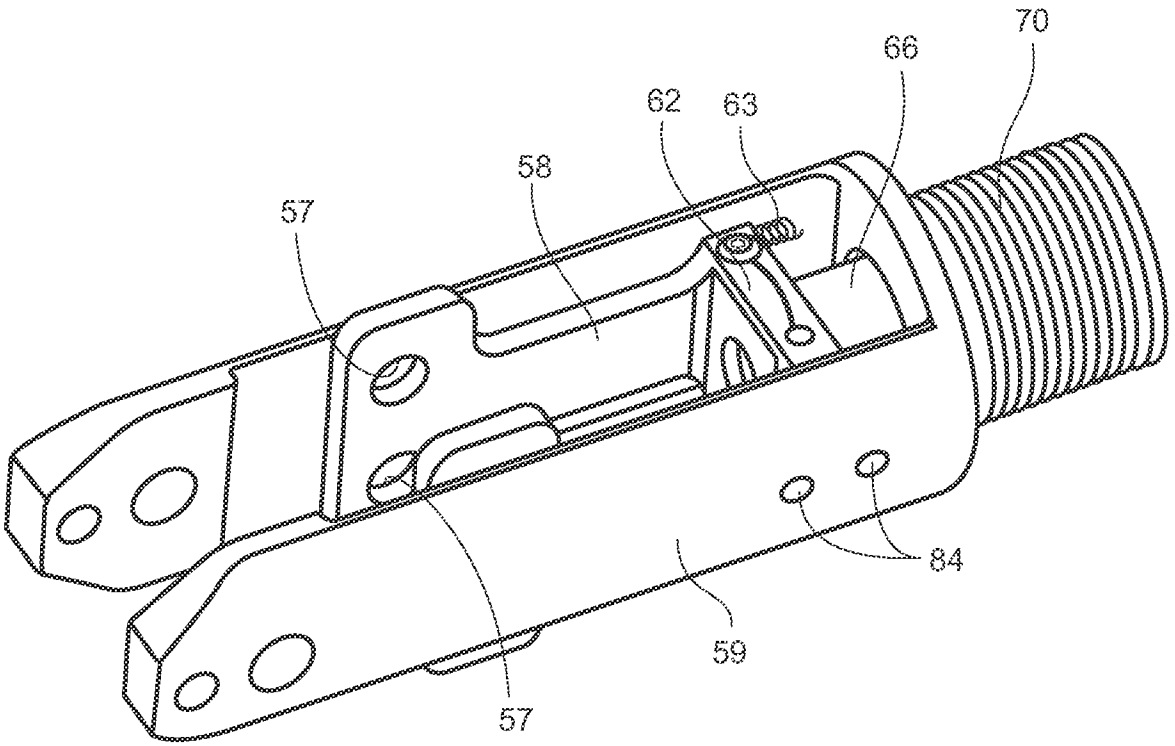
FIG. 4 is an enlarged perspective view of the transmission according to above preferred embodiment of the present invention.

The pair of clamping arms 32 are driven by a pairs of wing-like drive plates 52, 54 that are mounted for fore and aft pivoting movement to the clamping arms 32 by bolts 48. The inboard ends of the drive plates 52, 54 are mounted by pins 56 positioned in holes 57 in a drive plate mounting bracket 58 that is positioned in the transmission housing 59, as best shown in FIG. 4. The free ends of the drive plates 52, 54 have mounting holes 60 that receive mounting bolts 62. For strength and proper stress dispersion and balance, the drive plates 52, 54 are positioned on the top and bottom of the clamping arms 32. The drive plate mounting bracket 58 also houses an indicator light and sensor assembly 62, enclosed by a protective cover 64 that provides a visual indication that the jaws 34 have reached their full closed position.

The drive plate mounting bracket 58 also includes a bushing 66 with a threaded bore 68 that fits concentrically into the transmission housing 59, and a externally-threaded bushing 70 on the rearward-facing end of the transmission housing 59.

The transmission assembly "T" is attached to the jaw assembly "J" by a connecting bolt 72 and nut 74, and transmission mounting screws 76 that are threaded into mounting bore 78. The transmission assembly "T" includes a transmission cover 80 with locking screw access ports 82 that receive Allen locking screws that lock the cover 80 to the interior parts of the transmission assembly "T". The access ports 82, two of which reside on opposite sides of the cover 80 align with screw holes 84 on the transmission housing 59.

Figure 6:
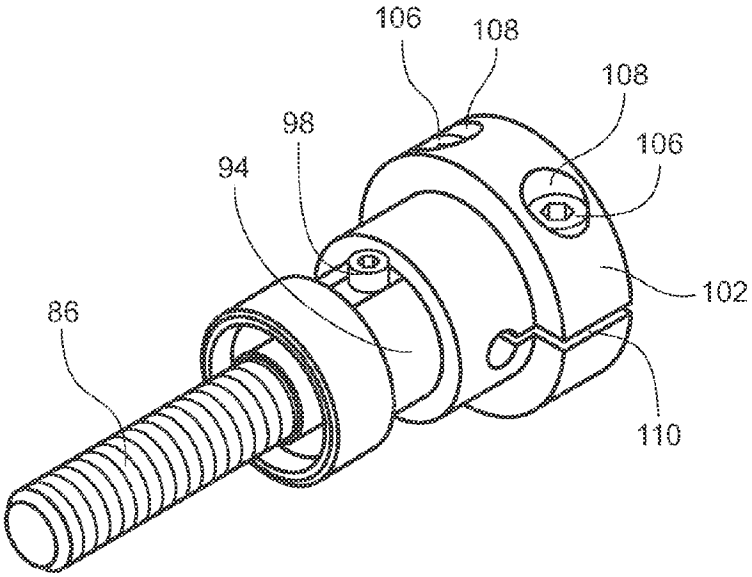
FIGS. 6 and 7 are perspective views of the adaptor assembly according to the preferred embodiment of the present invention.
Figure 7:
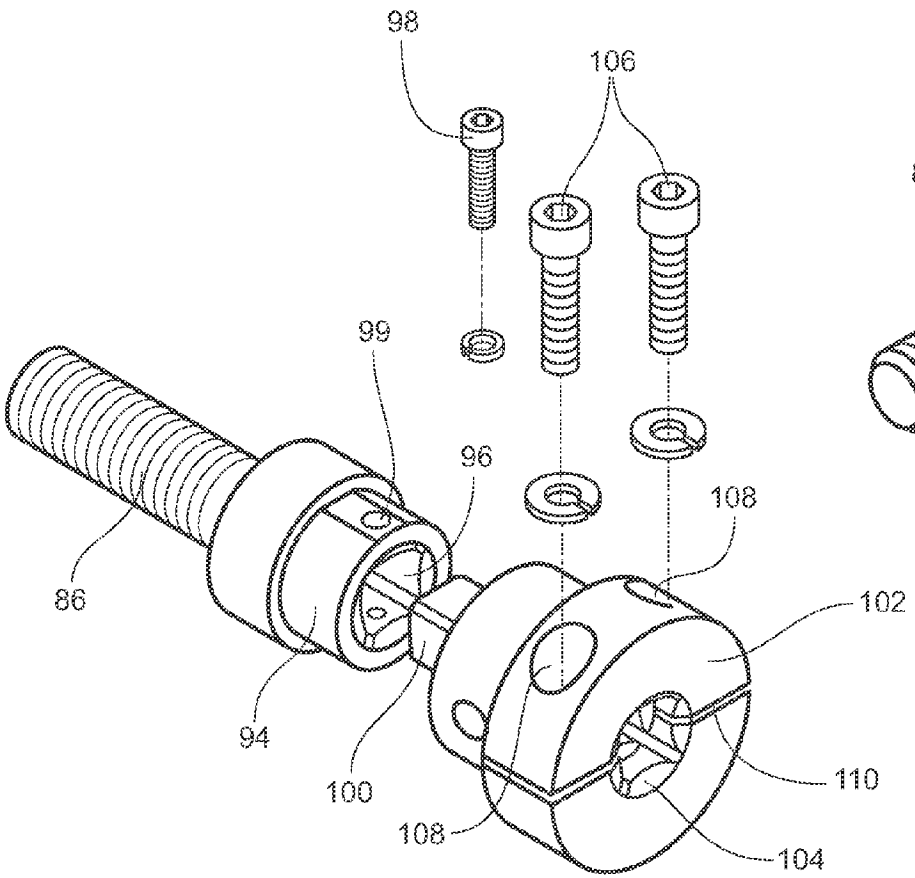

Referring to FIG. 2, a drive screw 86, preferably with trapezoidal screw threads, extends through the bushing 70 and is threaded into the threads 68 of the bushing 66 on the ends of the drive plate mounting bracket 58. Trapezoidal screw threads with 30 degree thread slope have been found particularly suitable for providing a smooth, hang-free motion. A thrust bearing 88 is positioned on the drive screw 86. The drive screw cover 90 includes interior screw threads 92 by which the drive screw cover 90 is screwed onto the bushing 70. As is best shown in FIGS. 6 and 7, the drive screw 86 includes a drive head 94 that encloses a socket 96 with a locking screw 98 that communicates with the socket 96 through a screw hole 99. The universal connection assembly "U" includes an anvil 100 for being positioned into the socket 96 of the drive head 94 and locked into position with the locking screw 98. The anvil 100 is carried on a downstream end of an adaptor head 102 that includes a socket 104 for receiving the anvil "A" of the impact wrench "W". The anvil "A" is locked into place with a pair of Allen screws 106 that are positioned in holes 108 that extend through the adaptor head 102 from one side to the other. The adaptor head 102 is radially split to form a gap 110. The anvil "A" is locked into place by the screws 106, which, as tightened, draw the gap 110 closed into a tight, locking position on the anvil "A."

Figure 5:
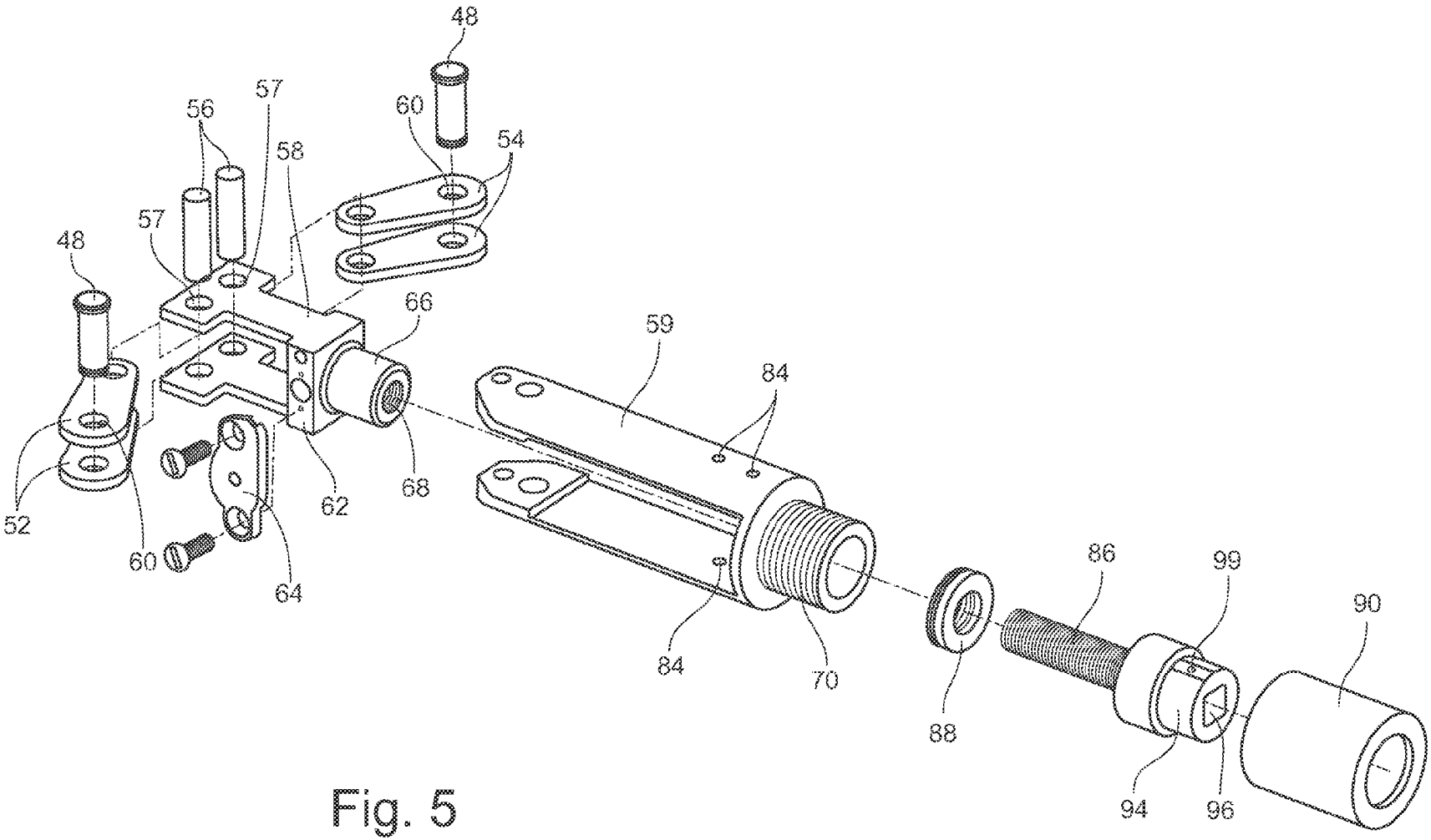
FIG. 5 is an exploded perspective view of the transmission according to the preferred embodiment of the present invention.

Nylok brand fastener coatings may be used on screws to reduce loosening of the screws by vibration. See FIG. 5.

In operation, activation of the impact wrench "W" to close the jaws 34 around a connection to be crimped rotates the anvil "A", rotating the adaptor head 102 and the drive head 94. As the threaded drive screw 86 on the drive head 94 rotates, the drive plate mounting bracket 58 is driven rearwardly in the transmission housing 59 away from the clamping arms 32. This rearward motion has the effect of driving the rear ends of the drive plates 52 and 54 away from each other, causing rearward ends of the clamping arms 32 to diverge, and the jaws 34 on the forward end of the clamping arms 32 to draw towards each other into the crimping position with the jaws 34 together. As is shown in FIG. 4, as the jaws 34 close to the crimping position a spring 63 touches a rear end of the transmission housing 59, closing a circuit and activating an indicator light of the indicator light and sensor assembly 62, signaling the operator to release the trigger of the impact wrench "W."

To reverse the process and open the jaws 34, the impact wrench "W" is reversed, reversing the motion of the adaptor head 102 and the downstream elements described above. Because the crimping head 10 is completely independent of the particular configuration and size of the impact wrench being used, it is unnecessary to provide various attachment components specific to various configurations and sizes. Anvils, such as anvil "A" are a standard size across the universe of different brands and models in the United States. Thus, by providing a crimping head that requires only an attachment to the anvil of the impact wrench, the number of components necessary to provide with the crimping head 10 is substantially reduced. There is also a substantial saving of time because of the lack of need to attach the crimping head to parts of the impact wrench other than the anvil.

A crimping head according to the invention for use with an impact wrench has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A crimping head for use with an impact wrench to crimp fittings onto a structure carrying the fitting, comprising:

(a) a universal adaptor having a bifurcated head, and a diametrically adjustable socket positioned in the bifurcated head being sized and shaped to receive multiple sized impact wrench anvils without further connection between the impact wrench and the crimping head;

(b) a locking assembly positioned in the bifurcated head adapted to concurrently adjust an outer diameter of the bifurcated head and a diameter of the adjustable socket for locking various sized impact wrench anvils into the adjustable socket by advancing a fastener through the bifurcated head:

(c) a transmission attached to the universal adaptor for being driven by the universal adaptor and for converting rotational movement of the anvil into selective rearward and forward movement; and (d) a jaw assembly attached to the transmission and adapted to close into a crimping position and open into a release position responsive to the rearward and forward movement of the transmission.

2. A crimping head according to claim 1, wherein the transmission comprises:

(a) a housing mounted in a stationary position between the universal adaptor and the jaw assembly;

(b) a mounting plate positioned for forward and rearward movement within the housing responsive to rotation of the anvil of the impact wrench;

(c) a pair of drive plates mounted for pivotal movement on the mounting plate responsive to forward and rearward movement within the housing responsive to rotation of the anvil of the impact wrench; and (d) the drive plates being mounted on rearward ends of clamping arms carried by the jaw assembly, wherein outward movement of forward ends of the drive plates drives rearward ends of the clamping arms outwardly and forward ends of the clamping arms having opposing jaws inwardly into crimping position.

3. A crimping head according to claim 1, wherein the locking assembly comprises a radial split in the bifurcated head formed on an outer periphery of the bifurcated head and extending through to the diametrically adjustable socket thereby defining a gap, at least one through hole extending through the bifurcated head and split, the at least one through hole being perpendicular relative to a longitudinal axis of the adjustable socket, and a screw positioned in the at least one through hole for being tightened to close the gap and lock the anvil in the diametrically adjustable socket.

4. A crimping head according to claim 1, and including a cover positioned over at least a rearward portion of the transmission.

5. A crimping head according to claim 2; wherein the bifurcated head includes a drive screw threaded into a bore formed in the mounting plate for driving the mounting plate forwardly and rearwardly in the transmission housing.

6. A crimping head according to claim 5, wherein the drive screw includes trapezoidal screw threads.

7. A crimping head according to claim 5, and including a transmission cover positioned over at least a rearward portion of the transmission and a drive screw cover positioned over the drive screw.

8. A crimping head according to claim 1, wherein the transmission comprises:

(a) an elongate housing mounted in a stationary position between the universal adaptor and the jaw assembly, and having a top and bottom defining a movement path;

(b) a mounting plate positioned for forward and rearward movement within the movement path of the housing responsive to rotation of the anvil of the impact wrench;

(c) a pair of drive plates mounted for pivotal movement on the mounting plate responsive to forward and rearward movement within the housing responsive to rotation of the anvil of the impact wrench; and (d) the drive plates being mounted on rearward ends of clamping arms carried by the jaw assembly, wherein outward movement of forward ends of the drive plates drives rearward ends of the clamping arms outwardly and forward ends of the clamping arms having opposing jaws inwardly into crimping position.

9. A crimping head according to claim 1, in combination with an electric impact wrench.

10. A method of crimping a fitting onto a structure carrying the fitting; and comprising the steps of:

(a) providing crimping head for use with an impact wrench to crimp fittings onto a structure carrying the fitting, comprising:

(i) a universal adaptor having a bifurcated head, and a diametrically adjustable socket positioned in the bifurcated head being sized and shaped to receive various sized impact wrench anvils without further connection between the impact wrench and the crimping head;

(ii) a locking assembly positioned in the bifurcated head adapted to concurrently adjust an outer diameter of the bifurcated head and a diameter of the adjustable socket for locking various sized impact wrench anvils into the adjustable socket by advancing a fastener through the bifurcated head:

(iii) a transmission attached to the universal adaptor for being driven by the universal adaptor and for converting rotational movement of the anvil into selective rearward and forward movement; and (iv) a jaw assembly attached to the transmission and adapted to close into a crimping position and open into a release position responsive to the rearward and forward movement of the transmission; and (b) activating the impact wrench to drive the jaw assembly into a crimping position.

* * * * *